US007243463B1

(12) United States Patent
Lucero

(10) Patent No.: US 7,243,463 B1
(45) Date of Patent: Jul. 17, 2007

(54) WINDOW COVER SYSTEM

(76) Inventor: Mayra J. Lucero, 909 E. 23rd St., Hialeah, FL (US) 33013

( * ) Notice: Subject to any disclaimer, the term of this patent is extended or adjusted under 35 U.S.C. 154(b) by 79 days.

(21) Appl. No.: 11/253,877

(22) Filed: Oct. 19, 2005

(51) Int. Cl.
*E05C 21/02* (2006.01)

(52) U.S. Cl. ..... 49/465; 49/466; 49/463; 49/50; 49/55; 49/57; 49/61; 52/202

(58) Field of Classification Search ..... 49/50, 49/55, 57, 61, 463, 465, 466; 52/202, 203
See application file for complete search history.

(56) References Cited

U.S. PATENT DOCUMENTS 2,928,146 A * 3/1960 Kuniholm ..... 49/465
3,163,205 A * 12/1964 Robert ..... 160/216
3,837,118 A 9/1974 Goss, Jr. et al.
3,908,730 A 9/1975 Goss, Jr. et al.
4,121,379 A * 10/1978 Everson ..... 49/61
4,368,594 A 1/1983 Milam et al.
4,676,024 A * 6/1987 Rossman ..... 49/62
5,255,479 A * 10/1993 Shepherd ..... 55/127.8
5,283,975 A 2/1994 Piterski
5,446,996 A * 9/1995 Lamont ..... 49/57
5,787,642 A * 8/1998 Coyle et al. ..... 49/61
D401,351 S 11/1998 Miyoshi et al.
5,943,832 A * 8/1999 Russell ..... 52/202
6,532,702 B1 3/2003 Scribner
2002/0017065 A1 * 2/2002 Clewis ..... 52/202

* cited by examiner

*Primary Examiner*—Jerry Redman
(74) *Attorney, Agent, or Firm*—Lawrence J. Gibney, Jr.

(57) ABSTRACT

This is a storm window protection device which will fit over the window fame of a building and lock into position to prevent damage to the window during periods of inclement weather.

6 Claims, 4 Drawing Sheets

WINDOW COVER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This device prevents damage to windows particularly during periods of inclement weather. It will fit over the outside of the window and will contain a handle as well as two locking devices to keep the device in place. The locking devices will fit within the interior of the frame of the window and secure the device over the outside of the window. A protective barrier, which is sized to fit over the area of the window will fit within the perimeter of the device and protects the window from flying debris.

B. Prior Art

There are many other references in the prior art concerning storm protection devices related to windows. Representative examples of these include Goss, Jr. U.S. Pat. No. 3,837,118 and Pieterski U.S. Pat. No. 5,283,975.

The means of accomplishing the particular object of the prior art is different than the current application in many respects and therefore the current application is unique and novel.

BRIEF SUMMARY OF THE INVENTION

This is a device, which is contained as one unit and is used to cover a window during periods of inclement weather. It will have a handle in the approximate center, a protective board or barrier, a set of locking handles and an exterior frame. The exterior frame of the device will fit within the frame of the window that is being protected. The locking handles will press the device against the interior perimeter of the frame for the window. This device may be installed to fit over any type of window including sliding glass doors.

A protective barrier will cover the interior area of the frame of this device and provide full coverage for the window once it is installed. One of the greatest dangers during inclement weather is flying debris. The protective barrier should be constructed of durable material to withstand the forces, which may be caused by flying debris.

A pair of locking devices will be positioned above and below the carrying handle. The locking devices possess flanged surfaces at both ends which, when the device is installed, will press against the outside structure of the building and allow the device to remain in place. A seal around the outside perimeter of the frame of device will ensure a relatively tight fit around the window frame of the building after it is installed.

It is an object of this device to be able to easily install a set of protective coverings for windows particularly during periods of inclement weather. Because of exposure to the elements it is anticipated that this device will be made of suitable material to protect the window from flying debris.

DRAWING REFERENCE NUMBERS

Figure 1:
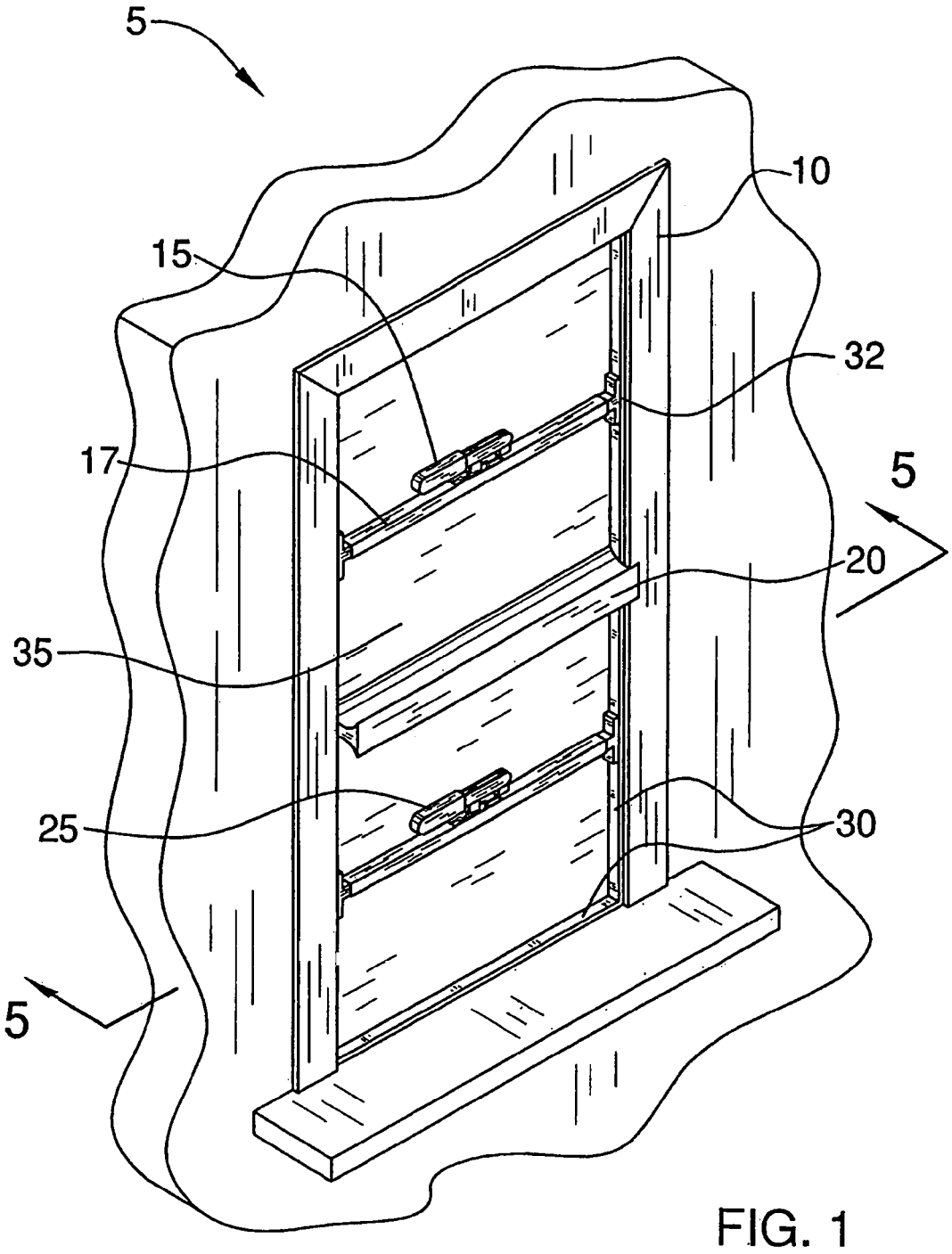
FIG. 1 is an isometric view of the device installed.
Figure 2:
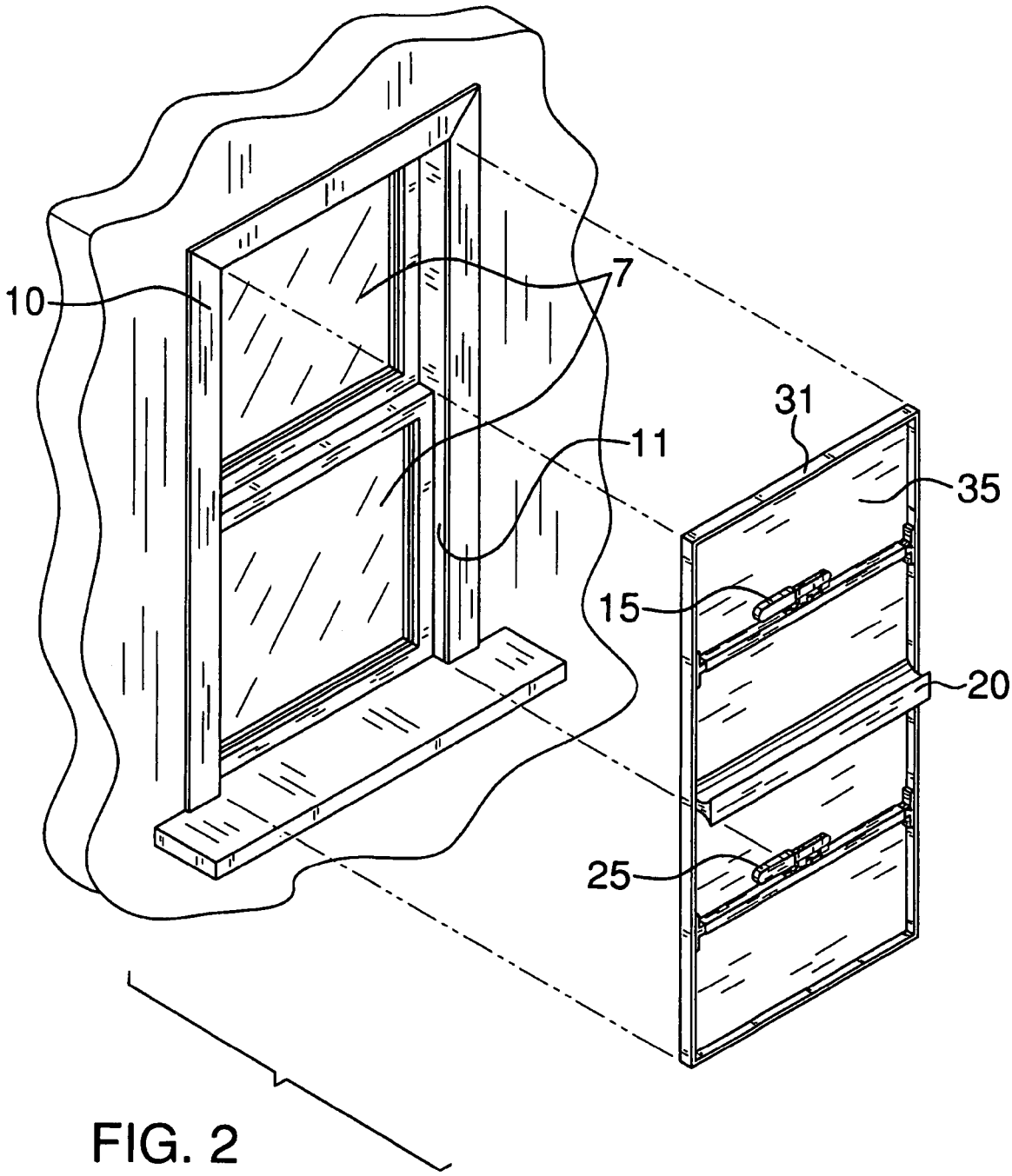
FIG. 2 is an isometric representation of the placement of the device over the window frame.

Item number 5: device
Item number 7: window
Item number 10: window frame
Item number 11: building window frame-inside perimeter.
Item number 15: upper locking bar
Item number 17: locking arm casing
Item number 17B: bottom of the locking arm casing
Item number 17T: top of the locking arm casing
Item number 20: carrying handle
Item number 25: lower locking bar
Item number 26: locking bar
Item number 28: spring
Item number 30: frame
Item number 31: seal
Item number 32: flanged member
Item number 35: protective barrier
Item number 40: linkage
Item number 41: locking arm handle
Item number 42: pivot points

DETAILED DESCRIPTION OF THE EMBODIMENT

This is a storm protection device 5 that is specifically designed to cover a window during periods of inclement weather. It is designed to fit over the outside of the window to protect the window from flying debris. FIG. 1 It may be designed to fit over any type of window including sliding glass doors.

In the middle of the device 5 will be a handle 20 to transport the device and also to place the device in the building window frame 10 prior to locking the device 5 using the upper locking device 15 and lower locking device 25. The operation of the upper locking device 15 and lower locking device 25 are identical.

The device 5 is comprised of a frame 30 and around the outside perimeter of the frame a material 31 to seal the frame 30 more securely may be provided to insure a tight fit against the surface of the building frame 11 for the window 7. FIG. 1, 2 The seal 31 may be made from neoprene or rubber or other suitable non-slippery or non-skid material. Flanged surfaces 32 on the ends of the locking devices will press against the interior surface of the frame 30 and when appropriate pressure is applied by the locking devices 15, 25 the device 5 will remain in place in the interior frame of the window 11. FIG. 1

Installed with the device 5 and covering the entire interior of the device will be a protective barrier 35. This protective barrier 35 must withstand the forces that are generated by flying debris in order to protect the window 7. The protective material may be wood, hard plastic or even metal. FIG. 1,2

The device is equipped with a carrying handle 20 in the approximate middle of the device and is placed inside the window frame 10 against the interior surface of the building frame 11. FIG. 1, 2 The device frame 30, which surrounds the protective barrier 35 abuts the interior surface of the window frame 11. FIG. 1

Figure 3:
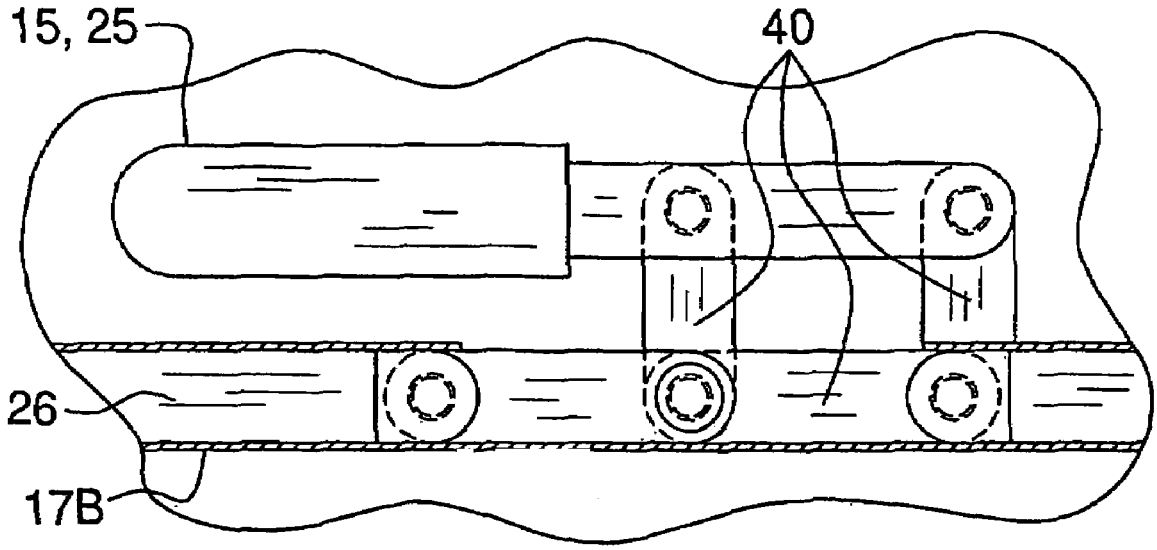
FIG. 3 is a partially fragmented view of the locking device of the device in the locked position.

Both the upper locking device 15 and the lower locking device 25 have a locking bar 26 and locking bar casing 27 FIG. 3, 4 The locking bar casing 27 is a guide for the locking bar 26 and to provide additional support when the device 5 is installed. FIG. 3

Figure 4:
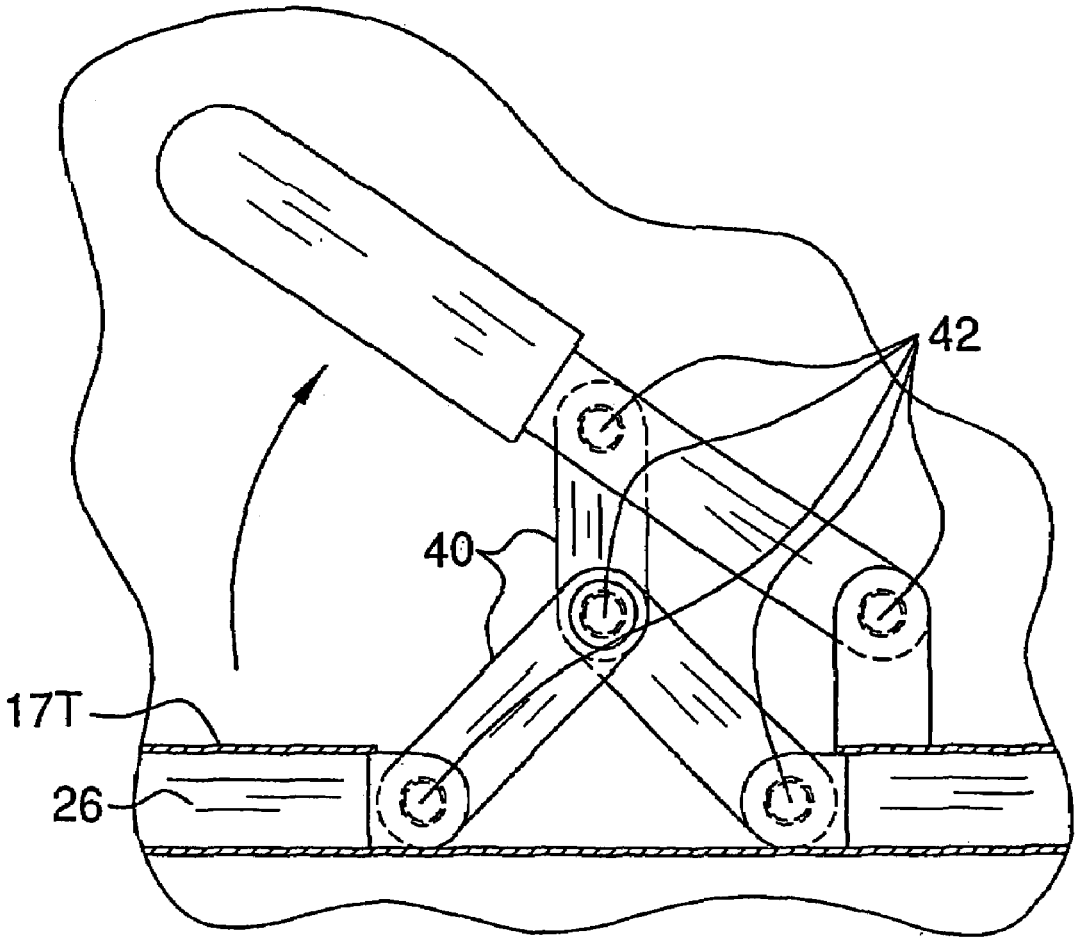
FIG. 4 is a partially fragmented view of the locking device in the open position.

Handles are provided for each of the locking bars 15, 25. The locking handle is secured to the locking bar casing 27 using appropriate linkage 40 with pivot points 42. FIG. 4 The means of attachment for the pivot points 42 will be rivets or nuts and bolts. This will allow the handles to move from the locked position such as depicted in FIG. 3 to the open or unlocked position as depicted in FIG. 4. On the ends of the respective locking bars will be a flanged member 32, which presses against the interior of the device.

When the device 5 is installed the respective locking handle is moved in a downward fashion. This movement forces the linkage 40 of the locking bar 26 to move through the locking bar casing 17, which has a solid top surface 17T and a solid bottom surface 17B and allows the flanged member 32 of each of the locking bars against the frame of the device 30 against the interior of the window frame. The pressure, which is exerted by the locking devices, will maintain the position of the device within the interior of the window frame 11.

When the device is not in operation and needs to be removed the locking handles 15 are moved upward and the pressure against the side of the window frame 10 is relieved in order to move the device 5.

Within the interior of the locking bar casing 27 is a spring 28 which will allow the device to be placed on many different types of window frames 10.

Figure 5:
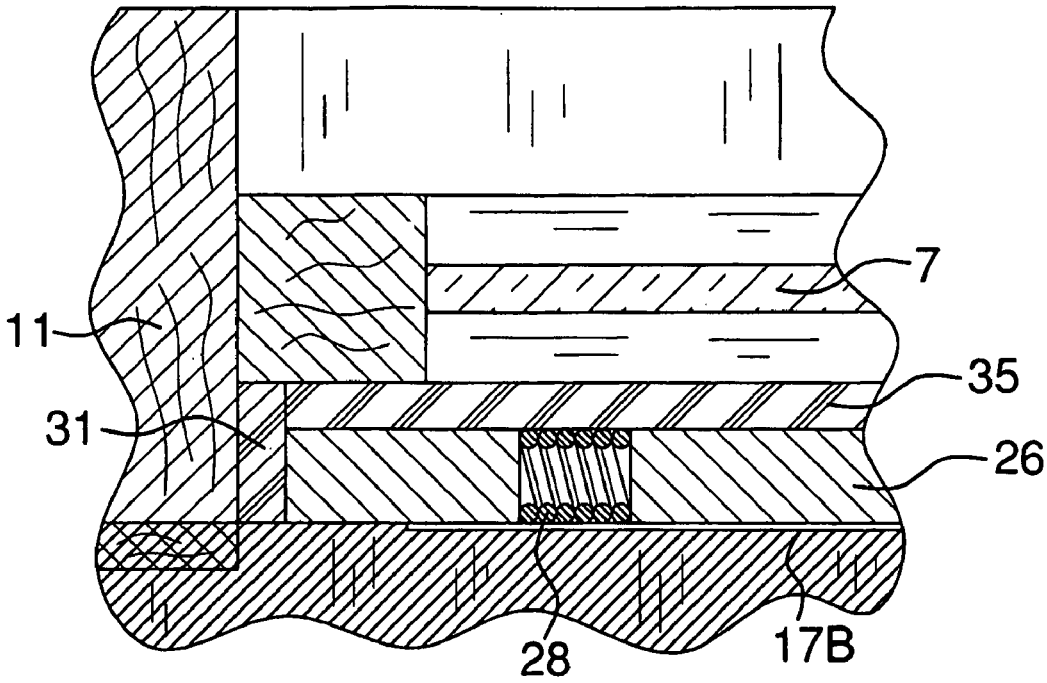
FIG. 5 is a view according to line 5-5 on FIG. 1.
Figure 6:
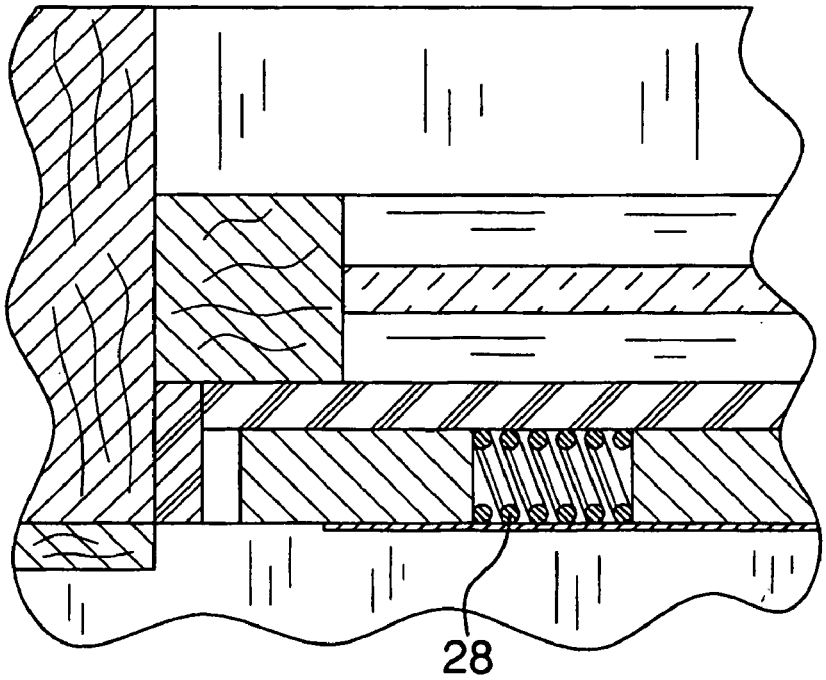
FIG. 6 is a partially fragmented view of FIG. 5 in the open position.

When the device is in the locked position the spring 28 is depicted in FIG. 5. When the device not locked into position the spring 28 is depicted in FIG. 6.

While the embodiments of the invention have been disclosed, certain modifications may be made by those skilled in the art to modify the invention without departing from the spirit of the invention.

The invention claimed is:

1. A device for protecting windows which is comprised of:

a. a frame;

wherein the frame fits within a frame structure for a window for a building;

b. a carrying handle;

wherein the carrying handle is provided on the device;

wherein the carrying handle is secured to a protective barrier;

c. wherein the protective barrier is of a predetermined thickness;

said protective barrier covers the entire interior perimeter of the frame;

d. locking devices;

wherein a plurality of locking devices are provided;

wherein the locking devices are provided with a locking handle;

wherein the locking devices are connected to a plurality of linkages;

wherein pivot points are provided to connect the linkages to the locking handle;

wherein the linkages are connected to a locking bar;

said locking bar extends from one side of the frame to the other;

wherein flanged members are provided on the ends of the locking bar;

wherein movement of the linkages causes movement of the locking bar;

e. a seal;

wherein a seal is secured to the outside perimeter of the frame;

f. wherein the flanged members abut the frame.

2. The device as described in claim 1 wherein the protective barrier is a wooden board.

3. The device as described in claim 1 wherein the protective barrier is a sheet of hard plastic.

4. The device as described in claim 1 wherein the protective barrier is a sheet of metal.

5. The device in claim 1 further comprising the seal formed of neoprene.

6. The device in claim 1 further comprising the seal formed of rubber.

* * * * *